US010186101B2

(12) United States Patent
Zhang et al.

(10) Patent No.: US 10,186,101 B2
(45) Date of Patent: Jan. 22, 2019

(54) METHOD, DEVICE AND SYSTEM FOR CONTROLLING OPENING OF A-B DOORS

(71) Applicant: Hangzhou Hikvision Digital Technology Co., Ltd., Hangzhou, Zhejiang (CN)

(72) Inventors: Dong Zhang, Zhejiang (CN); Weichang Kang, Zhejiang (CN); Xianlin Zhao, Zhejiang (CN)

(73) Assignee: Hangzhou Hikvision Digital Technology Co., Ltd., Hangzhou, Zhejiang (CN)

( * ) Notice: Subject to any disclaimer, the term of this patent is extended or adjusted under 35 U.S.C. 154(b) by 0 days.

(21) Appl. No.: 15/739,855

(22) PCT Filed: Nov. 2, 2016

(86) PCT No.: PCT/CN2016/104350
§ 371 (c)(1),
(2) Date: Dec. 26, 2017

(87) PCT Pub. No.: WO2018/010343
PCT Pub. Date: Jan. 18, 2018

(65) Prior Publication Data

US 2018/0374293 A1 Dec. 27, 2018

(30) Foreign Application Priority Data

Jul. 13, 2016 (CN) ..... 2016 1 0555430

(51) Int. Cl.
*G07C 9/00* (2006.01)

(52) U.S. Cl.
CPC ..... *G07C 9/00912* (2013.01); *G07C 9/0069* (2013.01); *G07C 9/00563* (2013.01); *G07C 9/00309* (2013.01); *G07C 2209/08* (2013.01)

(58) Field of Classification Search
CPC ..... G07C 9/00912; G07C 9/00563; G07C 9/0069; G07C 2209/08; G07C 9/00309; G07C 2009/00412; G07C 2009/00793
(Continued)

(56) References Cited

U.S. PATENT DOCUMENTS 6,806,807 B2 * 10/2004 Cayne ..... G07C 9/00087 340/5.52
2018/0293825 A1 * 10/2018 Denton ..... G07C 9/00309

FOREIGN PATENT DOCUMENTS

CN 102867350 A 1/2013
CN 103778702 A 5/2014

* cited by examiner

*Primary Examiner* — Ali Neyzari
(74) *Attorney, Agent, or Firm* — Bret E. Field; Bozicevic, Field & Francis LLP

(57) ABSTRACT

A method, device and system for controlling opening of A-B doors are disclosed, which are applicable to a host of a system with A-B doors, the system with A-B doors comprising a first access control for controlling entry through the door A, a second access control for controlling entry through the door B and an electronic authorization conversion device. The method comprises: receiving a first verification request for an object to be verified sent by the first access control (S201); determining whether the object to be verified has authorization to pass through the door A (S202); if it does, sending an opening command for opening the door A to the first access control (S203); receiving, after the door A has been opened, an electronic authorization conversion request for the object to be verified sent by the electronic authorization conversion device, converting the authorization of the object to be verified to authorization to pass through the door B, determining a first validity time period for passing through the door B, and storing the first validity time period (S204); receiving a second verification request
(Continued)

for the object to be verified sent by the second access control (S205); retrieving the stored first validity time period (S206); determining whether the door B can be opened (S207); if it does, sending an opening command for opening the door B to the second access control (S208), thus improving the security of A-B doors.

22 Claims, 6 Drawing Sheets

(58) Field of Classification Search
USPC ..... 340/5.21
See application file for complete search history.

METHOD, DEVICE AND SYSTEM FOR CONTROLLING OPENING OF A-B DOORS

The present application claims the priority to a Chinese patent application No. 201610555430.9 filed with the State Intellectual Office of People's Republic of China on Jul. 13, 2016 and entitled "Method, device and system for controlling opening of A-B doors", which is incorporated herein by reference in its entirety.

TECHNICAL FIELD

The present application relates to the field of security technology, and particularly to a method, device and system for controlling the opening of A-B doors.

BACKGROUND

The function of A-B doors, also known as double interlocked doors, is that: the door B cannot be opened when the door A is open, and can be opened only when the door A is closed; conversely, the door A cannot be opened when the door B is open. In other words, the two doors each locks the other. A-B doors are usually used in the entrances and exits of important premises such as banks, prisons, and vaults. FIG. 1 is a schematic view of an application scenario of A-B doors, which includes a public area, a door A, a transit area, a door B, and a supervised area. A host of the system with A-B doors is connected to, respectively, an entrance access control and an exit switch button at the door A, an entrance access control and an exit switch button at the door B, and an electronic authorization conversion device between the A-B doors.

When a cardholder swipes a card at the entrance access control of the door A, the entrance access control reads the card number and sends it to the host. When the host determines that the card number has the authorization to pass through the door A, it sends an opening command to the entrance access control. After the person has entered the transit area, an electronic authorization conversion is performed, that is, the host controls the electronic authorization conversion device, so that the electronic authorization conversion device converts the authorization of the card to the door B, after which the cardholder can open the door B.

When the person returns from the supervised area to the public area, the door A and the door B can be opened by means of the two exit switch buttons.

In the prior art, after a person has passed the verification at the door A from the public area and undergone the electronic authorization conversion, the authorization of the person's card is converted to the door B. In other words, the person can pass the verification at the door B and enter the supervised area.

However, if the card of the person is lost or stolen in the supervised area, then the card may still have the authorization for the door B, which will pose a certain risk to the security of the A-B doors. For example, if an unauthorized person obtains a card authorized for the door B, then the unauthorized person can enter the transit area by hacking the authorization for the door A, and then pass the verification at the door B by using the obtained card and enter the supervised area.

SUMMARY

An object of embodiments of the present application is to provide a method, device and system for controlling opening of A-B doors capable of improving the security of A-B doors.

The present application discloses a method for controlling opening of A-B doors, applicable to a host of a system with A-B doors, the system with A-B doors further including a first access control for controlling entry through the door A, a second access control for controlling entry through the door B and an electronic authorization conversion device. The method includes:

receiving a first verification request for an object to be verified sent by the first access control;

determining whether the object to be verified has authorization to pass through the door A according to the first verification request, and if so, sending an opening command for opening the door A to the first access control;

receiving, after the door A has been opened, an electronic authorization conversion request for the object to be verified sent by the electronic authorization conversion device, converting the authorization of the object to be verified to authorization to pass through the door B, determining a first validity time period for passing through the door B, and storing the first validity time period;

receiving a second verification request for the object to be verified sent by the second access control;

retrieving the stored first validity time period;

determining whether the door B can be opened according to the second verification request and the first validity time period, and if so, sending an opening command for opening the door B to the second access control.

Optionally, determining the first validity time period for passing through the door B includes:

generating the first validity time period for the object to be verified to pass through the door B by using time of sending the opening command for opening the door A to the first access control as starting time and based on a predetermined duration of time period.

Optionally, storing the first validity time period includes:

storing the first validity time period in the host; or sending the first validity time period to the electronic authorization conversion device for the electronic authorization conversion device to write the first validity time period into the object to be verified;

retrieving the stored first validity time period includes:

reading the first validity time period stored in the host; or retrieving the first validity time period contained in the second verification request, the first validity time period having been read from the object to be verified by the second access control and added into the second verification request.

Optionally, the second verification request contains a timestamp indicating time at which the object to be verified is read;

determining whether the door B can be opened according to the second verification request and the first validity time period includes:

determining whether the door A is closed, and if it is not closed, determining that the door B cannot be opened;

and if it is closed, determining whether the object to be verified has the authorization to pass through the door B according to the second verification request, and if it does not, determining that the door B cannot be opened;

and if it does, determining whether the timestamp is within the first validity time period according to the timestamp contained in the second verification request, and if it is, determining that the door B can be opened, otherwise, determining that the door B cannot be opened.

Optionally, the system with A-B doors further includes a third access control for controlling exit through the door B and a fourth access control for controlling exit through the door A. The method further includes:

receiving a third verification request for the object to be verified sent by the third access control;

determining whether the door B can be opened according to the third verification request and the first validity time period, and if so, sending an opening command for opening the door B to the third access control;

receiving, after the door B has been opened, an electronic authorization conversion request for the object to be verified sent by the electronic authorization conversion device, converting the authorization of the object to be verified to the authorization to pass through the door A, determining a second validity time period for passing through the door A and storing the second validity time period;

receiving a fourth verification request for the object to be verified sent by the fourth access control;

retrieving the stored second validity time period;

determining whether the door A can be opened according to the fourth verification request and the second validity time period, and if so, sending an opening command for opening the door A to the fourth access control.

Optionally, determining the second validity time period for passing through the door A includes:

generating the second validity time period for the object to be verified to pass through the door A by using time of sending an opening command for opening the door B to the third access control as starting time and based on a predetermined duration of time period.

Optionally, storing the second validity time period includes:

storing the second validity time period in the host; or sending the second validity time period to the electronic authorization conversion device for the electronic authorization conversion device to write the second validity time period into the object to be verified;

retrieving the stored second validity time period includes:

reading the second validity time period stored in the host; or retrieving the second validity time period contained in the fourth verification request, the second validity time period having been read from the object to be verified by the fourth access control and added into the fourth verification request.

Optionally, the fourth verification request contains a timestamp indicating the time at which the object to be verified is read;

determining whether the door A can be opened according to the fourth verification request and the second validity time period include:

determining whether the door B is closed, and if it is not closed, determining that the door A cannot be opened;

and if it is closed, determining whether the object to be verified has the authorization to pass through the door A according to the fourth verification request, and if it does not, determining that the door A cannot be opened;

and if it does, determining whether the timestamp is within the second validity time period according to the timestamp contained in the fourth verification request, and if it is, determining that the door A can be opened, otherwise, determining that the door A cannot be opened.

The present application discloses a device for controlling opening of A-B doors, applicable to a host of a system with A-B doors, the system with A-B doors further including a first access control for controlling entry through the door A, a second access control for controlling entry through the door B and an electronic authorization conversion device.

The device includes:

a first receiving module, for receiving a first verification request for an object to be verified sent by the first access control;

a first determination module, for determining whether the object to be verified has authorization to pass through the door A according to the first verification request;

a first sending module, for sending an opening command for opening the door A to the first access control when it has been determined that the object to be verified has the authorization to pass through the door A;

a first authorization conversion module, for receiving, after the door A has been opened, an electronic authorization conversion request for the object to be verified sent by the electronic authorization conversion device, converting the authorization of the object to be verified to authorization to pass through the door B, determining a first validity time period for passing through the door B, and storing the first validity time period;

a second receiving module, for receiving a second verification request for the object to be verified sent by the second access control;

a first retrieving module, for retrieving the stored first validity time period;

a second determination module, for determining whether the door B can be opened according to the second verification request and the first validity time period; and a second sending module, for sending an opening command for opening the door B to the second access control when it has been determined that the door B can be opened.

Optionally, the first authorization conversion module includes: a first authorization conversion sub-module, a first validity time period determination sub-module and a first storage sub-module;

the first authorization conversion sub-module is for receiving, after the door A has been opened, the electronic authorization conversion request for the object to be verified sent by the electronic authorization conversion device, and converting the authorization of the object to be verified to the authorization to pass through the door B;

the first validity time period determination sub-module is for determining the first validity time period for passing through the door B;

the first storage sub-module is for storing the first validity time period.

Optionally, the first validity time period determination sub-module is specifically for generating the first validity time period for the object to be verified to pass through the door B by using time of sending the opening command for opening the door A to the first access control as starting time and based on a predetermined duration of time period.

Optionally, the first storage sub-module is specifically for:

storing the first validity time period in the host; or sending the first validity time period to the electronic authorization conversion device for the electronic authorization conversion device to write the first validity time period into the object to be verified;

the first retrieving module is specifically for:

reading the first validity time period stored in the host; or retrieving the first validity time period contained in the second verification request, the first validity time period having been read from the object to be verified by the second access control and added into the second verification request.

Optionally, the second verification request contains a timestamp indicating the time at which the object to be verified is read;

the second determination module is specifically for:

determining whether the door A is closed, and if it is not closed, determining that the door B cannot be opened;

and if it is closed, determining whether the object to be verified has the authorization to pass through the door B according to the second verification request, and if it does not, determining that the door B cannot be opened, and if it does, determining whether the timestamp is within the first validity time period according to the timestamp contained in the second verification request, and if it is, determining that the door B can be opened, otherwise, determining that the door B cannot be opened.

Optionally, the system with A-B doors further includes a third access control for controlling exit through the door B and a fourth access control for controlling exit through the door A. The device further includes:

a third receiving module, for receiving a third verification request for the object to be verified sent by the third access control;

a third determination module, for determining whether the door B can be opened according to the third verification request and the first validity time period;

a third sending module, for sending an opening command for opening the door B to the third access control when it has been determined that the door B can be opened;

a second authorization conversion module, for receiving, after the door B has been opened, an electronic authorization conversion request for the object to be verified sent by the electronic authorization conversion device, converting the authorization of the object to be verified to the authorization to pass through the door A, determining a second validity time period for passing through the door A, and storing the second validity time period;

a fourth receiving module, for receiving a fourth verification request for the object to be verified sent by the fourth access control;

a second retrieving module, for retrieving the stored second validity time period;

a fourth determination module, for determining whether the door A can be opened according to the fourth verification request and the second validity time period; and a fourth sending module, for sending an opening command for opening the door A to the fourth access control when it has been determined that the door A can be opened.

Optionally, the second authorization conversion module includes: a second authorization conversion sub-module, a second validity time period determination sub-module and a second storage sub-module;

the second authorization conversion sub-module is for receiving, after the door B has been opened, the electronic authorization conversion request for the object to be verified sent by the electronic authorization conversion device, and converting the authorization of the object to be verified to the authorization to pass through the door A;

the second validity time period determination sub-module is for determining the second validity time period for passing through the door A;

the second storage sub-module is for storing the second validity time period.

Optionally, the second validity time period determination sub-module is specifically for:

generating the second validity time period for the object to be verified to pass through the door A by using time of sending the opening command for opening the door B to the third access control as starting time and based on a predetermined duration of time period.

Optionally, the second storage sub-module is specifically for:

storing the second validity time period in the host; or sending the second validity time period to the electronic authorization conversion device for the electronic authorization conversion device to write the second validity time period into the object to be verified;

the second retrieving module is specifically for:

reading the second validity time period stored in the host; or retrieving the second validity time period contained in the fourth verification request, the second validity time period having been read from the object to be verified by the fourth access control and added into the fourth verification request.

Optionally, the fourth verification request contains a timestamp indicating the time at which the object to be verified is read;

the fourth determination module is specifically for:

determining whether the door B is closed, and if it is not closed, determining that the door A cannot be opened;

and if it is closed, determining whether the object to be verified has the authorization to pass through the door A according to the fourth verification request, and if it does not, determining that the door A cannot be opened, and if it does, determining whether the timestamp is within the second validity time period according to the timestamp contained in the fourth verification request, and if it is, determining that the door A can be opened, otherwise, determining that the door A cannot be opened.

In order to achieve the above object, the present application also discloses a system with A-B doors including a host, a first access control for controlling entry through the door A, a second access control for controlling entry through the door B and an electronic authorization conversion device;

wherein, the host is for receiving a first verification request for an object to be verified sent by the first access control; determining whether the object to be verified has authorization to pass through the door A according to the first verification request, and if so, sending an opening command for opening the door A to the first access control; receiving, after the door A has been opened, an electronic authorization conversion request for the object to be verified sent by the electronic authorization conversion device, converting the authorization of the object to be verified to authorization to pass through the door B, determining a first validity time period for passing through the door B, and storing the first validity time period; receiving a second verification request for the object to be verified sent by the second access control; retrieving the stored first validity time period; determining whether the door B can be opened according to the second verification request and the first validity time period, and if so, sending an opening command for opening the door B to the second access control;

the first access control is for sending the first verification request for the object to be verified to the host, and receiving the opening command for opening the door A sent by the host;

the second access control is for sending the second verification request for the object to be verified to the host, and receiving the opening command for opening the door B sent by the host;

the electronic authorization conversion device is for sending, after the door A has been opened, the electronic authorization conversion request for the object to be verified to the host.

Optionally, the system with A-B doors further includes a third access control for controlling exit through the door B and a fourth access control for controlling exit through the door A;

wherein, the host is for receiving a third verification request for the object to be verified sent by the third access control; determining whether the door B can be opened according to the third verification request and the first validity time period, and if so, sending an opening command for opening the door B to the third access control; receiving, after the door B has been opened, an electronic authorization conversion request for the object to be verified sent by the electronic authorization conversion device, converting the authorization of the object to be verified to the authorization to pass through the door A, determining a second validity time period for passing through the door A, and storing the second validity time period; receiving a fourth verification request for the object to be verified sent by the fourth access control; retrieving the stored second validity time period; determining whether the door A can be opened according to the fourth verification request and the second validity time period, and if so, sending an opening command for opening the door A to the fourth access control;

the third access control is for: sending the third verification request for the object to be verified to the host; and receiving the opening command for opening the door B from the host;

the fourth access control is for: sending the fourth verification request for the object to be verified to the host; and receiving the opening command for opening the door A sent by the host;

the electronic authorization conversion device is for sending, after the door B has been opened, the electronic authorization conversion request for the object to be verified to the host.

In order to achieve the above object, embodiments of the present application provide a host of a system with A-B doors, the system with A-B doors further including a first access control for controlling entry through the door A, a second access control for controlling entry through the door B and an electronic authorization conversion device; the host including:

a housing, a processor, a memory, a circuit board and a power supply circuit, wherein, the circuit board is disposed inside the space enclosed by the housing, the processor and the memory are arranged on the circuit board; the power supply circuit is for supplying electrical power to each circuit or device of the host; the memory is for storing executable program codes; the processor executes programs corresponding to the executable program codes by reading the executable program codes stored in the memory to perform the following steps:

receiving a first verification request for an object to be verified sent by the first access control;

determining whether the object to be verified has authorization to pass through the door A according to the first verification request, and if so, sending an opening command for opening the door A to the first access control;

receiving, after the door A has been opened, an electronic authorization conversion request for the object to be verified sent by the electronic authorization conversion device, converting the authorization of the object to be verified to authorization to pass through the door B, determining a first validity time period for passing through the door B, and storing the first validity time period;

receiving a second verification request for the object to be verified sent by the second access control;

retrieving the stored first validity time period;

determining whether the door B can be opened according to the second verification request and the first validity time period, and if so, sending an opening command for opening the door B to the second access control.

In order to achieve the above object, embodiments of the present application provide an application program for executing the method for controlling the opening of A-B doors provided by the embodiments of the present application when being executed, wherein, the method for controlling the opening of A-B doors includes:

receiving a first verification request for an object to be verified sent by a first access control;

determining whether the object to be verified has authorization to pass through the door A according to the first verification request, and if so, sending an opening command for opening the door A to the first access control;

receiving, after the door A has been opened, an electronic authorization conversion request for the object to be verified sent by an electronic authorization conversion device, converting the authorization of the object to be verified to the authorization to pass through the door B, determining a first validity time period for passing through the door B, and storing the first validity time period;

receiving a second verification request for the object to be verified sent by a second access control;

retrieving the stored first validity time period;

determining whether the door B can be opened according to the second verification request and the first validity time period, and if so, sending an opening command for opening the door B to the second access control.

In order to achieve the above object, embodiments of the present application provide a storage medium for storing executable codes for executing the method for controlling the opening of A-B doors provided by the embodiments of the present application when being executed, wherein the method for controlling the opening of A-B doors includes:

receiving a first verification request for an object to be verified sent by a first access control;

determining whether the object to be verified has authorization to pass through the door A according to the first verification request, and if it has, sending an opening command for opening the door A to the first access control;

receiving, after the door A has been opened, an electronic authorization conversion request for the object to be verified sent by an electronic authorization conversion device, converting the authorization of the object to be verified to the authorization to pass through the door B, determining a first validity time period for passing through the door B, and storing the first validity time period;

receiving a second verification request for the object to be verified sent by a second access control;

retrieving the stored first validity time period;

determining whether the door B can be opened according to the second verification request and the first validity time period, and if so, sending an opening command for opening the door B to the second access control.

It can be seen from the above technical solutions, in the embodiments of the present invention, according to a received first verification request for an object to be verified sent by the first access control, an opening command for opening the door A is sent to the first access control when it is determined that the object to be verified has authorization to pass through the door A. After the door A has been opened, and the electronic authorization conversion request for the object to be verified sent by the electronic authorization conversion device has been received, the authorization of the object to be verified is converted to the authorization to pass through the door B, a first validity time period for passing through the door B is determined, and the first validity time period is stored. Then, the stored first validity time period is retrieved when a second verification request for the object to be verified sent by the second access control has been received, and whether the door B can be opened is determined according to the second verification request and the first validity time period, and if so, an opening command for opening the door B is sent to the second access control.

In other words, in the embodiments of the present application, when the door A has been opened and the electronic authorization conversion request for the object to be verified sent by the electronic authorization conversion device has been received, not only is the authorization of the object to be verified to be converted to the authorization to pass through the door B, but also the first validity time period for passing through the door B is to be determined. Then, when the second verification request for the object to be verified has been received, whether the door B can be opened is determined according to the first validity time period. In the prior art, when electronic authorization conversion takes place, only the authorization of the object to be verified is converted to the authorization to pass through the door B, and thereafter, if the object to be verified no longer undergoes any electronic authorization conversion, its authorization will remain as the authorization to pass through the door B. Therefore, the security of the A-B doors is not high enough. The embodiments of the present application, by setting the authorization to pass through the door B to be valid within the first validity time period, is capable of improving the security of A-B doors.

BRIEF DESCRIPTION OF THE DRAWINGS

In order to explain the technical solutions of embodiments of the present application or of the prior art more clearly, the accompanying drawings to be used in the description of the embodiments and of the prior art will be described briefly below. Obviously, the accompanying drawings described below are only some embodiments of the present application. Those with ordinary skills in the art can obtain other drawings based on these drawings without any creative efforts.

DETAILED DESCRIPTION

The technical solutions of the embodiments of the present application will be clearly and completely described below in conjunction with the accompanying drawings of the embodiments of the present application. Obviously, the described embodiments are merely some of the embodiments of the present application, rather than all of them. All other embodiments obtained based on the embodiments of the present application by those ordinary persons skilled in the art without any creative efforts fall into the scope of protection of the present application.

The embodiments of the present application provide a method, device and system for controlling the opening of A-B doors capable of improving the security of A-B doors. The method is applicable to a host of a system with A-B doors. The system with A-B doors further includes a first access control for controlling entry through the door A, a second access control for controlling entry through the door B, and an electronic authorization conversion device.

The present application will be described in detail below by means of specific embodiments.

Figure 1:
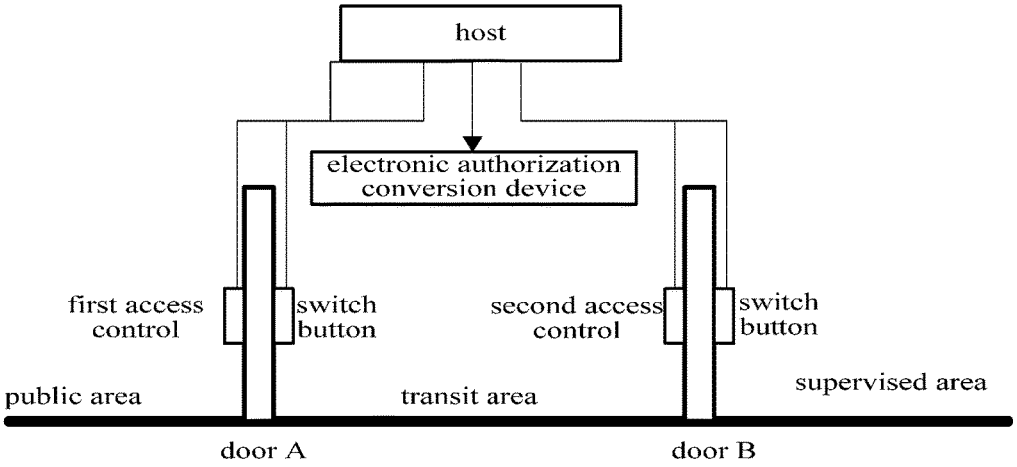
FIG. 1 is a schematic view of the connection of devices of a system with A-B doors.

FIG. 1 is a schematic view of the connection of devices of a system with A-B doors, which includes a public area, a door A, a transit area, a door B and a supervised area. The door A separates the public area from the transit area, and the door B separates the supervised area from the transit area. The first access control for controlling personnel entering through the door A is located on the side of the public area, and the second access control for controlling personnel entering through the door B is located on the side of the transit area. A switch button for controlling personnel exiting through the door A is provided at the door A on the side of the transit area, and a switch button for controlling personnel exiting through the door B is provided at the door B on the side of the supervised area. The transit area is further provided with an electronic authorization conversion device for personnel to undergo electronic authorization conversion. FIG. 1 also shows the circuit connection of the devices, wherein the host of the system with A-B doors is electrically connected to (i.e., in communication connection with), respectively, the first access control, the second access control, the electronic authorization conversion device and the two switch buttons.

Figure 2:
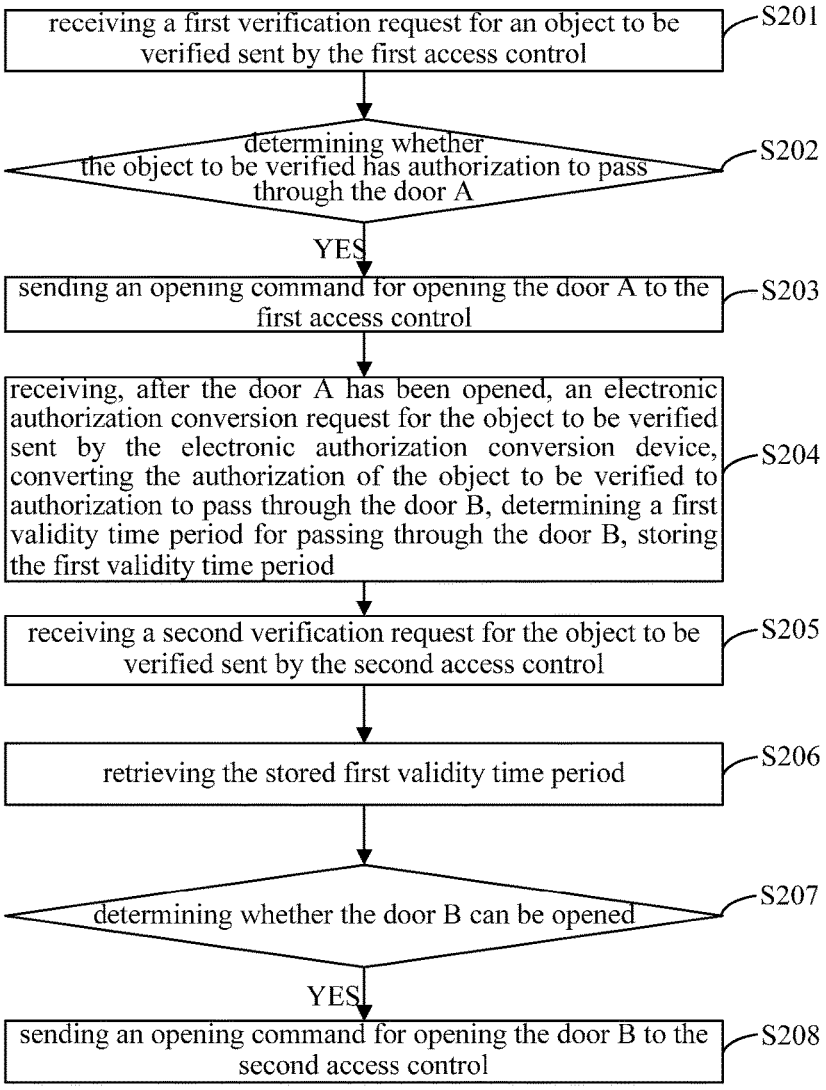
FIG. 2 is a schematic flowchart of a method for controlling the opening of A-B doors provided by embodiments of the present application.

FIG. 2 is a schematic flowchart of the method for controlling the opening of A-B doors provided by embodiments of the present application, the method including the following steps:

Step S201: receiving a first verification request for an object to be verified sent by the first access control.

In general, the verification methods for an object to be verified of an access control are of two types, in which, one is by the swiping of a card, and the other is by the collection of biological features. Correspondingly, the object to be verified can be of two types: one is of the type of a card, and the other is of the type of a biological feature, such as fingerprints, palm prints, irises, faces and the like of a person to be verified. The verification method of the access control and the type of the object to be verified are not specifically limited by the embodiments of the present application.

In general, the first access control and the second access control use the same type of access control devices, and verify the object to be verified by the same verification method. The first access control and the second access control can use devices of the card-swiping type, or use devices of the biological-feature type. The electronic authorization conversion device generally uses an device of the same type as the first and the second access controls.

In practical applications, for a device of the card-swiping type, an access control device can include a card reader and a door lock. The card reader is for reading verification information of the card and sending the read verification information to the host. The door lock is for receiving a door opening command sent by the host to open the door A or the door B.

For a device of the biological-feature-collection type, an access control device can include a biological feature collector and a door lock. The biological feature collector is for collecting a biological feature of a human body, matching it against stored corresponding relations between biological features and numbers, adding the matched number into a verification message and sending it to the host. The door lock is for receiving an opening command for opening a door sent by the host and opening the door A or the door B.

Specifically, the first access control reads the verification information of the object to be verified and sends a first verification request carrying the verification information to the host, and the host receives the first verification request sent by the first access control.

Step S202: determining whether the object to be verified has authorization to pass through the door A according to the first verification request, and if so, performing Step S203, otherwise, performing no action, i.e., keeping the door A in a closed state.

Specifically, the first verification request carries verification information, the host determines whether the object to be verified has the authorization to pass through the door A according to the verification information, and if so, sends an opening command to the first access control for opening the door A.

In practical applications, when the type of the first access control is different, the verification information in the corresponding first verification request will also be different, and the way that the host determines whether the object to be verified has the authorization to pass through the door A according to this verification information will also be different. A description will be given below for different situations.

If the first access control is a device of the card-swiping type (i.e., the object to be verified is a card), there exists two ways:

One is: the verification information carries a card number of the card. The host determines whether the card has the authorization to pass through the door A according to a corresponding relation between the card number and the authorization stored in itself.

The other is: the verification information carries an authorization identifier stored in the card, and the host determines whether the authorization identifier is an identifier corresponding to the door A, and if it is, determining that the card has the authorization to pass through the door A, otherwise, determining that the card does not have the authorization to pass through the door A, wherein, the authorization identifier, having been pre-stored in a card, is read from the card by the first access control. In practical applications, in order to improve security, the authorization identifier stored in a card can be encrypted. Thus, the first access control also needs to decrypt the storage area of a card before reading the authorization identifier from the card.

If the first access control is a device of the biological-feature type, the object to be verified is a biological feature of a person, and the verification information carries the number of the biological feature. The host determines whether the person has authorization to pass through the door A according to corresponding relations between a number and the authorization stored in itself. The process in which the first access control obtains the verification information includes: collecting a biological feature of the person, such as fingerprints, determining the number of the biological feature of the person according to the corresponding relations between biological features and numbers stored in itself, and adding the number to the verification information.

Step S203: sending an opening command for opening the door A to the first access control.

Step S204: receiving, after the door A has been opened, an electronic authorization conversion request for the object to be verified sent by the electronic authorization conversion device, converting the authorization of the object to be verified to authorization to pass through the door B, determining a first validity time period for passing through the door B, and storing the first validity time period.

After the door A has been opened, the person can enter the transit area through the door A. If the person wants to continue to pass through the door B, he or she must undergo an electronic authorization conversion on the electronic authorization conversion device.

Specifically, the converting the authorization of the object to be verified to the authorization to pass through the door B can be implemented in different ways, which are described in detail below.

If the electronic authorization conversion device is a device of the card-swiping type (i.e., the object to be verified is a card), the converting the authorization of the card to the authorization to pass through the door B can be implemented in two ways:

One is: the electronic authorization conversion device reads a card number of the card, and sends the electronic authorization conversion request carrying the card number to the host. After having received the electronic authorization conversion request, the host converts the authorization corresponding to the card number in the corresponding relations between card numbers and authorizations stored in itself to the authorization to pass through the door B.

The other is: the electronic authorization conversion device reads a card number of the card and sends the electronic authorization conversion request carrying this card number to the host. The host sends an authorization conversion notification to the electronic authorization conversion device according to the received electronic authorization conversion request, so that the electronic authorization conversion device converts the authorization identifier stored in the card to an identifier corresponding to the door B according to the authorization conversion notification. In practical applications, in order to improve the security of card information, after the authorization identifier stored in a card has been converted by the electronic authorization conversion device to an identifier corresponding to the door B, the encryption key of the storage area of the card where the authorization identifier is stored can also be modified.

If the electronic authorization conversion device is an device of the biological-feature type, the electronic authorization conversion device collects a biological feature of a person, determines the number of the biological feature of the person according to the corresponding relations between biological features and numbers stored in itself, adds the number into the electronic authorization conversion request and sends it to the host computer. After having received the electronic authorization conversion request, the host converts the authorization corresponding to the number in the corresponding relations between numbers and authorizations stored in itself to the authorization to pass through the door B.

In the present embodiment, determining the first validity time period for passing through the door B can include: generating the first validity time period for the object to be verified to pass through the door B by using as the starting time the time of sending the opening command for opening the door A to the first access control and based on a predetermined duration of time period.

For example, the predetermined duration of time period can be 5 minutes or 2 hours. The predetermined duration of time period can be set according to specific application scenarios. For example, assuming the time the first access control sends the opening command for opening the door A is 8:30 and the predetermined duration of time period is 10 minutes, then the generated first validity time period is 8: 30-8: 40.

In the present embodiment, storing the first validity time period can be implemented in different ways.

If the electronic authorization conversion device is a device of the card-swiping type, the first validity time period can be stored in the host, or the first validity time period can be sent to the electronic authorization conversion device for the electronic authorization conversion device to write the first validity time period into the object to be verified. In order to prevent the data from being tampered with, the encryption key of the storage area of the card where the first validity time period is stored can also be modified by the electronic authorization conversion device.

If the electronic authorization conversion device is a device of the biological-feature type, the first validity time period is generally stored in the host since the first validity time period cannot be written into the object to be verified.

It can be understood that if the electronic authorization conversion device is an device of the card-swiping type, the authorization identifier of the authorization to pass through the door B can be sent to the electronic authorization conversion device together with the first validity time period for the electronic authorization conversion device to write both the authorization identifier and the first validity time period into the storage area of the card.

In practical applications, for the commonly used Mifare 1 (M1) card, information such as the authorization identifier of the authorization to pass through the door B and the first validity time period can be written into one sector of the M1 card, and the encryption key of the sector can be modified by the electronic authorization conversion device to prevent data from being tampered with. The following table shows the first validity time period and the authorization identification information stored in a sector of a M1 card, wherein, the time the authorization starts to take effect is the starting time of the first validity time period and the time the authorization ends is the end time of the first validity time period. The current authorization identifier is B, which indicates that the card has the authorization to pass through the door B during the above time period.

| Contents stored in a sector of a M1 card: | |
|---|---|
| Block 1: the time the authorization starts to take effect | YYMMDDHHMMSS |
| Block 2: the time the authorization ends | YYMMDDHHMMSS |
| Block 3: current authorization identifier | B |

Step S205: receiving a second verification request for the object to be verified sent by the second access control.

If the second access control is a device of the card-swiping type, the verification information carried in the second verification request can be a card number of a card, or can also be an authorization identifier stored in a card. It can be understood that if the first validity time period is stored in the card, the second access control can also read the first validity time period and add the first validity time period into the second verification request.

If the second access control is a device of the biological-feature type, the verification information carried in the second verification information is generally a number corresponding to a biological feature.

Step S206: retrieving the stored first validity time period.

Corresponding to how the first validity time period is stored by the host in the step S204, retrieving the stored first validity time period by the host can also be implemented in different ways.

If the second access control is an device of the card-swiping type, the host can read the first validity time period stored in the host, or obtain the first validity time period contained in the second verification request, wherein the first validity time period has been read from the object to be verified by the second access control, and added into the second verification request. In other words, the second access control can read the authorization identifier and the first validity time period stored in the card, and add the authorization identifier and the first validity time period into the second verification request and send it to the host.

If the second access control is a device of the biological-feature type, the host generally reads the first validity time period stored in the host since information such as the validity time period cannot be stored in the object to be verified.

Step S207: determining whether the door B can be opened according to the second verification request and the first validity time period, and if so, performing the Step S208, otherwise, performing no action, i.e., keeping the door B in a closed state.

If the second access control is a device of the card-swiping type, the second verification request can carry a card number of a card, in which case the host determines whether the door B can be opened according to the received card number and the retrieved first validity time period. The second verification request can also carry an authorization identifier, in which case the host determines whether the door B can be opened according to the received authorization identifier and the first validity time period. In the two cases described above, the second verification request can also carry the first validity time period. In other words, the first validity time period can be retrieved from the host, or from the second verification request.

If the second access control is a device of the biological-feature type, the second verification request can generally carry only the number corresponding to a biological feature, in which case the host determines whether the door B can be opened according to the received number of the biological feature and the first validity time period corresponding to the number stored in itself. Wherein, the first validity time period can be only retrieved from the host since information cannot be written into the object to be verified.

Step S208: sending an opening command for opening the door B to the second access control.

In summary, in the present embodiment, when the door A has been opened and the electronic authorization conversion request for the object to be verified sent by the electronic authorization conversion request has been received, not only is the authorization of the object to be verified to be converted to the authorization to pass through the door B, but also the first validity time period for passing through the door B is to be determined. Then, whether the door B can be opened is determined according to the first validity time period when the second verification request for the object to be verified has been received. In the prior art, only the authorization of the object to be verified is converted to the authorization to pass through the door B when an electronic authorization conversion is performed, and thereafter, if the object to be verified no longer undergoes any electronic authorization conversion, its authorization will remain as the authorization to pass through the door B. Therefore, the security of the A-B doors is not high enough. The embodiments of the present application sets the authorization to pass through the door B to be valid within the first validity time period, and the door B cannot be opened outside the first validity time period even with the authorization to pass through the door B. Therefore, the security of the A-B doors can be improved.

Figure 3:
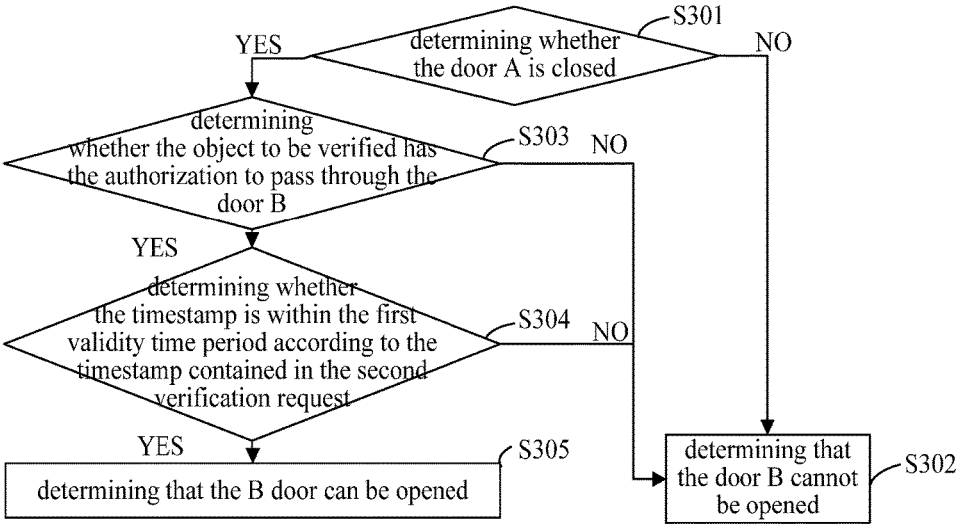
FIG. 3 is a schematic flowchart of the step S207 in FIG. 2.

In the embodiment shown in FIG. 2, the second verification request can contain a timestamp indicating the time at which the object to be verified is read. Correspondingly, the Step S207 of determining whether the door B can be opened according to the second verification request and the first validity time period can be as shown in FIG. 3, which specifically includes:

Step S301: determining whether the door A is closed, and if it is not closed, performing the step S302, and if it is closed, performing the step S303.

Specifically, determining whether the door A is closed can be achieved by detecting whether notification information indicating that the door A is closed sent by the first access control has been received. Specifically, the door lock in the first access control includes a sensor capable of sensing the state of the door A. The sensor can sense whether the door A is currently in a closed state or in an opened state, and send notification information indicating the state of the door A to the host through the door lock.

Step S302: determining that the door B cannot be opened.

Step S303: determining whether the object to be verified has the authorization to pass through the door B according to the second verification request, and if it does not, performing the Step S302, and if it does, performing the Step S304.

Specifically, when it has been determined, according to the second verification request, that the current authorization identifier of the object to be verified is the door B, it is then determined that the object to be verified has the authorization to pass through the door B.

It is to be noted that, determining whether the object to be verified has the authorization to pass through the door B according to the second verification request is similar to the step S202 (i.e., determining whether the object to be verified has the authorization to pass through the door A according to the first verification request). Cross-reference can be made to the related contents.

Step S304: determining whether the timestamp is within the first validity time period according to the timestamp contained in the second verification request, and if it is, performing the Step S305, otherwise, performing the Step S302.

In this step, the timestamp in the second verification request can be the time at which information of the object to be verified is read by the second access control, or that time plus a predetermined duration of time period. This is not specifically limited by the present application.

If it has been determined that the timestamp is not within the first validity time period, it means that the person to be verified fails to swipe the card at the second access control within the first validity time period, and therefore the door B cannot be opened.

Step S305: determining that the door B can be opened.

As can be seen from the above, in the present embodiment, only when the host has determined that the door A has been closed, the object to be verified has the authorization to pass through the door B, and the timestamp is within the first validity time period, is it determined that the door B can be opened. In other words, the door B can be opened only when the above three conditions are met, thus increasing the security of the door B.

In the embodiment shown in FIG. 2, exit through the doors A or B can be implemented in different ways. For example, a system with A-B doors can further include a button for controlling exit through the door B and a button for controlling exit through the door A. The buttons here are switch buttons. As shown in FIG. 1, when a person to be verified returns from the supervised area to the public area, he or she can successively pass through the door B and the door A by pushing the button at the door B and the button at the door A respectively. The method of the present embodiment can be applied in the scenario where it is necessary to strictly restrict the entry of personnel from the public area into the supervised area without the need to strictly restrict the return of personnel from the supervised area to the public area.

Of course, the system with A-B doors can include an access control for exit through the door B and an access control for exit through the door A. When a person to be verified exits through the door B or the door A, whether the door B or the door A can be opened is determined in the same manner as in the prior art. In the present embodiment, the process of exit through the door B or the door A is not limited.

Figure 4:
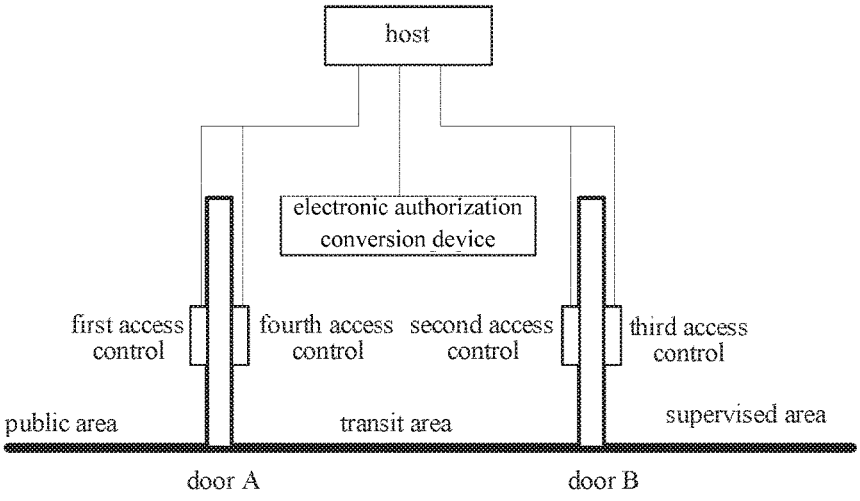
FIG. 4 is a schematic view of the connection of devices of another system with A-B doors.

FIG. 4 is a schematic view of the connection of devices of another system with A-B doors, which includes a public area, a door A, a transit area, a door B and a supervised area. The door A separates the public area from the transit area, and the door B separates the supervised area from the transit area. The first access control for controlling personnel entering through the door A is located on the side of the public area, and the second access control for controlling personnel entering through the door B is located on the side of the transit area. At the door A on the side of the transit area is provided with a fourth access control for controlling personnel exiting through the door A. At the door B on the side of the supervised area is provided with a third access control for controlling personnel exiting through the door B. The transit area is provided with an electronic authorization conversion device for performing electronic authorization conversion for personnel. FIG. 4 also shows the circuit connection of devices, wherein, the host of the system with A-B doors is electrically connected to (i.e., in communication connection with), respectively, the first access control, the second access control, the third access control, the fourth access control and the electronic authorization conversion device.

Figure 5:
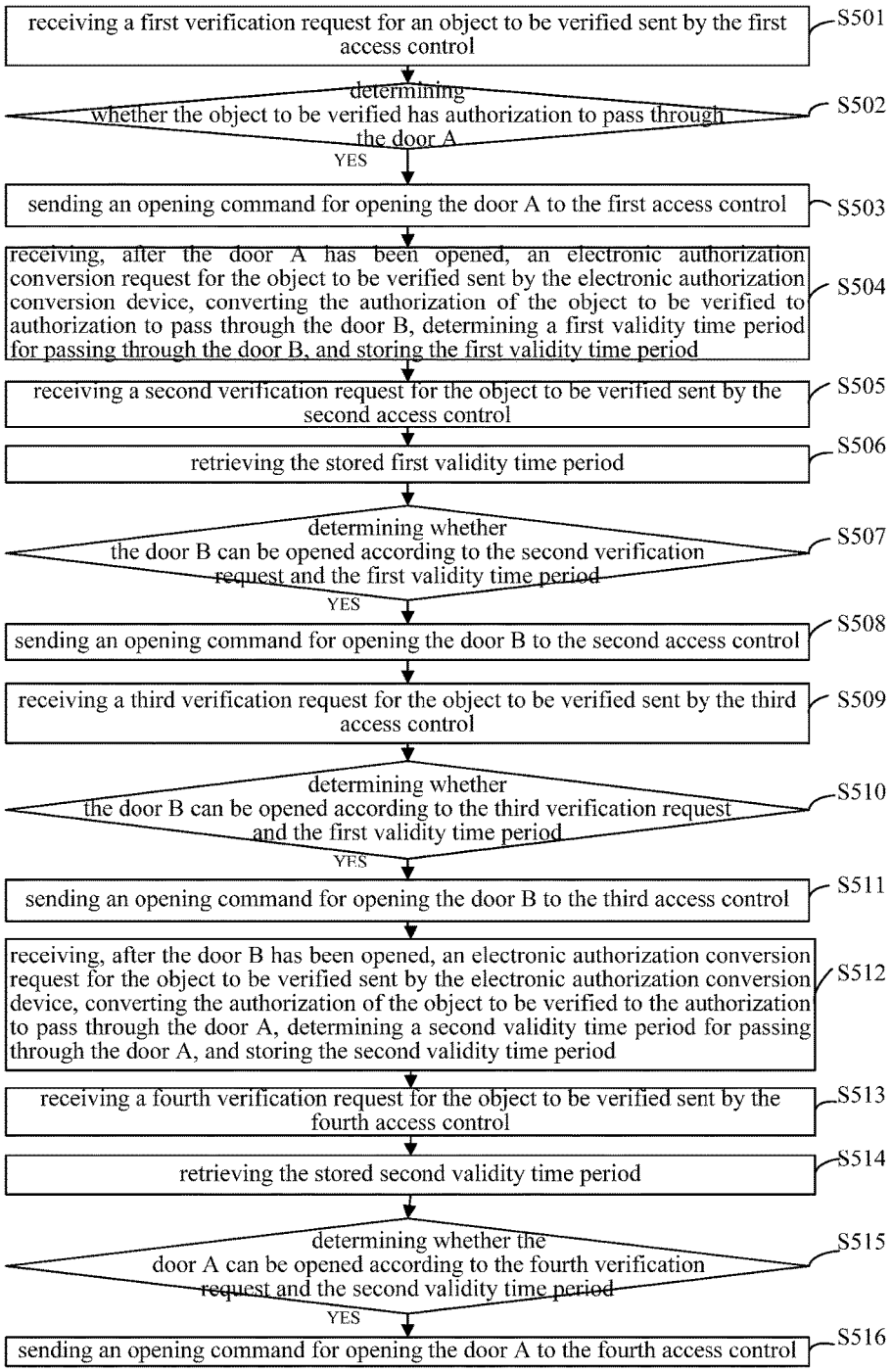
FIG. 5 is another schematic flowchart of the method for controlling the opening of A-B doors provided by embodiments of the present application.

FIG. 5 is another schematic flowchart of the method for controlling the opening of A-B doors provided by embodiments of the present application, the system with A-B doors further including a third access control for controlling exit through the door B and a fourth access control for controlling exit through the door A.

The Steps S501-S508 are completely identical to the Steps S201-S208 in the embodiment shown in FIG. 2, which will not be described herein.

It should be noted that, in the Step S504, when the authorization of the object to be verified is converted to the authorization to pass through the door B, it means that the person can no longer return to the public area, because the authorization of the object to be verified to pass through the door A has been converted to the authorization to pass through the door B, and the person cannot pass the verification at the fourth access control.

It should be noted that, in the present embodiment, the third access control and the fourth access control can be a device of the card-swiping type or of the biological-feature type. In general, the third access control and the fourth access control use access control devices of the same type as the first and the second access controls, and verify the object to be verified using the same verification method. The description below is given for the case where the types of the devices of the first to the fourth access controls are the same.

Step S509: receiving a third verification request for the object to be verified sent by the third access control.

If the third access control is a device of the card-swiping type, the verification information carried in the third verification request can be a card number of a card, or an authorization identifier stored in the card. It can be understood that when the first validity time period is stored in the card, the third access control can read the first validity time period and add the first validity time period into the third verification request.

If the third access control is a device of the biological-feature type, the verification information carried in the third verification information is generally a number corresponding to a biological feature.

Step S510: determining whether the door B can be opened according to the third verification request and the first validity time period, and if so, performing the Step S511, otherwise, performing no action, i.e., keeping the door B in a closed state.

If the third access control is a device of the card-swiping type, the third verification request can carry a card number of a card, in which case the host determines whether the door B can be opened according to the received card number and the retrieved first validity time period. The third verification request can also carry an authorization identifier, in which case the host determines whether the door B can be opened according to the received authorization identifier and the first validity time period. In the above two cases, the third verification request can also carry the first validity time period. In other words, the first validity time period can be retrieved from the host, or from the third verification request.

If the third access control is a device of the biological-feature type, the third verification request can generally carry only a number corresponding to a biological feature, in which case the host determines whether the door B can be opened according to the received number of the biological feature and the first validity time period corresponding to the number stored in itself, wherein, the first validity time period can only be retrieved from the host since information cannot be written into the object to be verified.

In the present embodiment, the first validity time period is for restricting the duration of the time period in which a person enters through the door B through the second access control, stays in the supervised area and exits through the door B through the third access control. In other words, in the Step S504, starting from the time when a person passes through the door B, he or she can complete the acts of entering through the door B through the second access control, staying in the supervised area, and exiting through the door B through the third access control only within the first validity time period.

In practical applications, the first validity time period in the present embodiment can be set to be relatively long, such as half an hour, two hours etc., depending on the actual requirements.

Step S511: sending an opening command for opening the door B to the third access control.

Step S512: receiving, after the door B has been opened, an electronic authorization conversion request for the object to be verified sent by the electronic authorization conversion device, converting the authorization of the object to be verified to the authorization to pass through the door A, determining a second validity time period for passing through the door A, and storing the second validity time period.

After the door B has been opened, a person can enter the transit area through the door B. If the person wants to continue to enter the public area through the door A, he or she must undergo an electronic authorization conversion on the electronic authorization conversion device.

Specifically, the converting the authorization of the object to be verified to the authorization to pass through the door A can be implemented in different ways, which will be described in detail below.

If the electronic authorization conversion device is a device of the card-swiping type (i.e., j), the converting of the authorization of the card the authorization to pass through the door A can be implemented in two ways:

One is: the electronic authorization conversion device reads a card number of the card, and sends the electronic authorization conversion request carrying the card number to the host. After having received the electronic authorization conversion request, the host converts the authorization corresponding to the card number in the corresponding relations between card numbers and authorizations stored in itself to the authorization to pass through the door A.

The other is: the electronic authorization conversion device reads a card number of the card and sends the electronic authorization conversion request carrying this card number to the host. The host sends an authorization conversion notification to the electronic authorization conversion device according to the received electronic authorization conversion request for the electronic authorization conversion device to convert an authorization identifier stored in the card to an identifier corresponding to the door A according to the authorization conversion notification. In practical applications, in order to improve the security of the card information, after the authorization identifier stored in the card has been converted by the electronic authorization conversion device to the identifier corresponding to the door A, the encryption key of the storage area of the card where the authorization identifier is stored can also be modified.

If the electronic authorization conversion device is a device of the biological-feature type, the electronic authorization conversion device collects a biological feature of a person, determines the number of the biological feature of the person according to the corresponding relations between biological features and numbers stored in itself, adds the number into the electronic authorization conversion request and sends it to the host computer. After having received the electronic authorization conversion request, the host converts the authorization corresponding to the number in the corresponding relations between numbers and authorizations stored in itself to the authorization to pass through the door A.

In the present embodiment, determining a second validity time period for passing through the door A can include: generating the second validity time period for the object to be verified to pass through the door A by using as the starting time the time of sending the opening command for opening the door A to the third access control and based on a predetermined duration of time period.

In the present embodiment, storing the second validity time period can be implemented in different ways.

If the electronic authorization conversion device is a device of the card-swiping type, the second validity time period can be stored in the host, or the second validity time period can be sent to the electronic authorization conversion device for the electronic authorization conversion device to write the second validity time period into the object to be verified. In order to prevent the data from being tampered with, the encryption key of the storage area of the card where the second validity time period is stored can also be modified by the electronic authorization conversion device.

If the electronic authorization conversion device is a device of the biological-feature type, the second validity time period is generally stored in the host since the second validity time period cannot be written into the object to be verified.

It can be understood that if the electronic authorization conversion device is a device of the card-swiping type, the authorization identifier of the authorization to pass through the door A can be sent to the electronic authorization conversion device together with the second validity time period for the electronic authorization conversion device to write both the authorization identifier and the second validity time period into the storage area of the card.

Step S513: receiving a fourth verification request for the object to be verified sent by the fourth access control.

If the fourth access control is a device of the card-swiping type, the verification information carried in the fourth verification request can be a card number of a card, or an authorization identifier stored in the card. It can be understood that if the second validity time period is stored in the card, the fourth access control can read the second validity time period and add the second validity time period into the fourth verification request.

If the fourth access control is a device of the biological-feature type, the verification information carried in the fourth verification request is generally a number corresponding to a biological feature.

Step S514: retrieving the stored second validity time period.

Corresponding to how the second validity time period is stored by the host in the Step S512, retrieving the stored second validity time period by the host can be implemented in different ways.

If the fourth access control is a device of the card-swiping type, the host can read the second validity time period stored in the host, or can retrieve the second validity time period contained in the fourth verification request, the second validity time period having been read from the object to be verified by the fourth access control and added into the fourth verification request. In other words, the fourth access control can read the authorization identifier and the second validity time period stored in the card, and add the authorization identifier and the second validity time period into the fourth verification request and send it to the host computer.

If the fourth access control is a device of the biological-feature type, the host typically reads the second validity time period stored in the host since information such as the validity time period cannot be stored in the object to be verified.

Step S515: determining whether the door A can be opened according to the fourth verification request and the second validity time period, and if so, performing the Step S516, otherwise, performing no action, i.e., keeping the door A in a closed state.

If the fourth access control is a device of the card-swiping type, the fourth verification request can carry a card number of a card, in which case the host determines whether the door A can be opened according to the received card number and the retrieved second validity time period. The fourth verification request can also carry an authorization identifier, in which case the host determines whether the door A can be opened according to the received authorization identifier and the second validity time period. In the above two cases, the fourth verification request can also carry the second validity time period. In other words, the second validity time period can be retrieved from the host, or from the fourth verification request.

If the fourth access control is a device of the biological-feature type, the fourth verification request can generally only carry a number corresponding to a biological features, in which case the host determines whether the door A can be opened according to the received number of the biological feature and the second validity time period corresponding to the number stored in itself, wherein, the second validity time period can be retrieved only from the host since information cannot be written into the object to be verified.

Step S516: sending an opening command for opening the door A to the fourth access control.

In summary, in the embodiment shown in FIG. 5, whether the door B can be opened is determined according to the third verification request and the first validity time period. After the door B has been opened, the authorization of the object to be verified is converted to the authorization to pass through the door A and the second validity time period for passing through the door A is determined. Whether the door A can be opened is determined according to the fourth verification request and the second validity time period. In other words, during the process in which a person returns from the supervised area to the public area, he or she needs to pass through the door B within the first validity time period, then pass through the door A within the second validity time period to ultimately enter the public area. In the embodiment shown in FIG. 2, a person can return from the supervised area to the public area merely by pushing the buttons at the A-B doors. Compared to FIG. 2, in the embodiment shown in FIG. 5, the time duration of the returning process of a person is further limited, and therefore the security of the A-B doors can be further improved.

Figure 6:
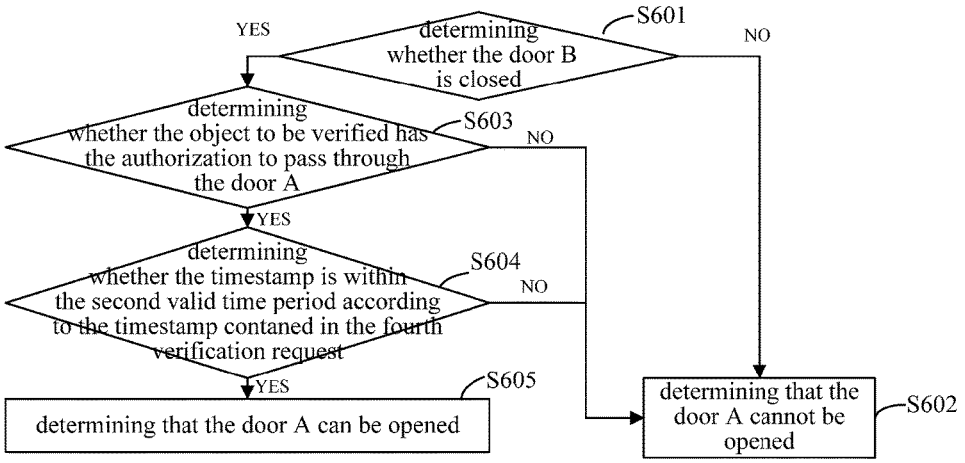
FIG. 6 is a schematic flowchart of the step S515 in FIG. 5.

In the embodiment shown in FIG. 5, the fourth verification request can contain a timestamp indicating the time at which the object to be verified is read. Correspondingly, the Step S515 of determining whether the door A can be opened according to the fourth verification request and the second validity time period can be as shown in FIG. 6, which specifically includes:

Step S601: determining whether the door B is closed, and if it is not closed, performing the Step S602, and if it is closed, performing the Step S603.

Specifically, determining whether the door B is closed can be achieved by detecting whether notification information indicating that the door B is closed sent by the third access control has been received. Specifically, the door lock in the third access control includes a sensor capable of sensing the state of the door B. The sensor can sense whether the door B is currently in a closed state or in an opened state, and send notification information indicating the state of the door B to the host through the door lock.

Step S602: determining that the door A cannot be opened.

Step S603: determining whether the object to be verified has the authorization to pass through the door A according to the fourth verification request, and if it does not, performing the Step S602, and if it does, performing the Step S604.

Specifically, when it is determined, according to the fourth verification request, that the current authorization identifier of the object to be verified is the door A, it is then determined that the object to be verified has the authorization to pass through the door A.

Step S604: determining whether the timestamp is within the second validity time period according to the timestamp contained in the fourth verification request, and if it is, performing the Step S605, otherwise, performing the Step S602.

In this step, the timestamp in the fourth verification request can be the time at which information of the object to be verified is read by the fourth access control, or that time plus a predetermined duration of time period, which is not specifically limited by the present application.

If it is determined that the timestamp is not within the second validity time period, it means that the person to be verified fails to swipe a card on the fourth access control within the second validity time period, and therefore the door A cannot be opened.

Step S605: determining that the door A can be opened.

As can be seen from the above, in the present embodiment, only when the host determines that the door B is closed, the object to be verified has the authorization to pass through the door A, and the timestamp is within the second validity time period is it determined that the door A can be opened. In other words, the door A can be opened only when the above three conditions are met, thus increasing the security of the door A.

In the embodiment shown in FIG. 5, the second validity time period is for restricting the duration of the time period in which a person opens the door A through the fourth access control, stays in the public area, and opens the door A through the first access control. The method of the present embodiment can be applied in the scenario in which a person needs to be constantly traveling between the public area and the supervised area.

From the embodiments shown in FIG. 2 and FIG. 5, it is not difficult to conclude that one of the third and the fourth access controls can be replaced by a switch button, thereby obtaining an embodiment different from those in FIG. 2 and FIG. 5, the specific process of which will not be described here.

Figure 7:
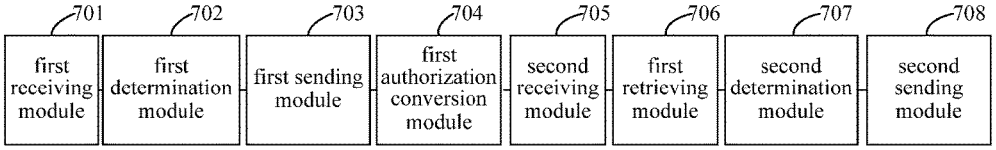
FIG. 7 is a schematic structural view a device for controlling the opening of A-B doors provided by embodiments of the present application.

FIG. 7 is a schematic structural view of a device for controlling the opening of A-B doors provided by embodiments of the present application, which corresponds to the method embodiment shown in FIG. 2. The device is applicable to a host of a system with A-B doors. The system with A-B doors further includes a first access control for controlling entry through the door A, a second access control for controlling entry through the door B and an electronic authorization conversion device. The device includes:

a first receiving module 701, for receiving a first verification request for an object to be verified sent by the first access control;

a first determination module 702, for determining whether the object to be verified has authorization to pass through the door A according to the first verification request;

a first sending module 703, for sending an opening command for opening the door A to the first access control when it has been determined that the object to be verified has the authorization to pass through the door A;

a first authorization conversion module 704, for receiving, after the door A has been opened, an electronic authorization conversion request for the object to be verified sent by the electronic authorization conversion device, converting the authorization of the object to be verified to authorization to pass through the door B, determining a first validity time period for passing through the door B, and storing the first validity time period;

a second receiving module 705, for receiving a second verification request for the object to be verified sent by the second access control;

a first retrieving module 706, for retrieving the stored first validity time period;

a second determination module 707, for determining whether the door B can be opened according to the second verification request and the first validity time period; and a second sending module 708, for sending an opening command for opening the door B to the second access control when it has been determined that the door B can be opened.

In the embodiment shown in FIG. 7, the first authorization conversion module 704 can include a first authorization conversion sub-module, a first validity time period determination sub-module and a first storage sub-module (not shown);

wherein, the first authorization conversion sub-module is for receiving, after the door A has been opened, the electronic authorization conversion request for the object to be verified sent by the electronic authorization conversion device, and converting the authorization of the object to be verified to the authorization to pass through the door B;

the first validity time period determination sub-module is for determining the first validity time period for passing through the door B;

the first storage sub-module is for storing the first validity time period.

In the embodiment shown in FIG. 7, the first validity time period determination sub-module can be specifically for generating the first validity time period for the object to be verified to pass through the door B by using time of sending the opening command for opening the door A to the first access control as starting time and based on a predetermined duration of time period.

In the embodiment shown in FIG. 7, the first storage sub-module can be specifically for:

storing the first validity time period in the host; or sending the first validity time period to the electronic authorization conversion device for the electronic authorization conversion device to write the first validity time period into the object to be verified;

the first retrieving module 706 is specifically for:

reading the first validity time period stored in the host; or retrieving the first validity time period contained in the second verification request, the first validity time period having been read from the object to be verified by the second access control and added into the second verification request.

In the embodiment shown in FIG. 7, the second verification request contains a timestamp indicating the time at which the object to be verified is read.

The second determination module 707 is specifically for:

determining whether the door A is closed, and if it is not closed, determining that the door B cannot be opened;

and if it is closed, determining whether the object to be verified has the authorization to pass through the door B according to the second verification request, and if it does not, determining that the door B cannot be opened, and if it does, determining whether the timestamp is within the first validity time period according to the timestamp contained in the second verification request, and if it is, determining that the door B can be opened, otherwise, determining that the door B cannot be opened.

Figure 8:
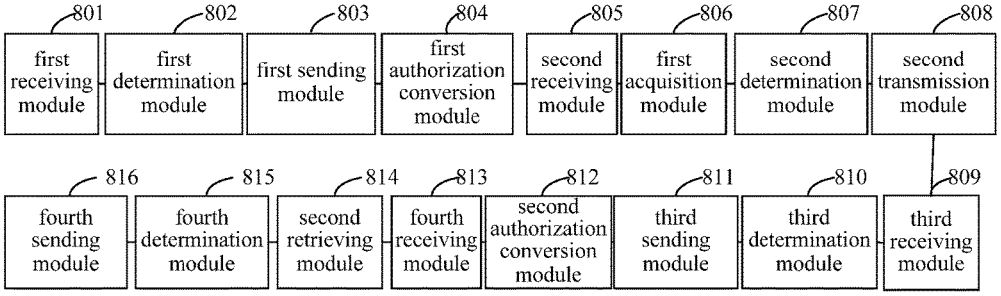
FIG. 8 is another schematic structural view of the device for controlling the opening of A-B doors provided by embodiments of the present application.

FIG. 8 is another schematic structural view of the device for controlling opening of A-B doors provided by embodiments of the present application, which corresponds to the method embodiment shown in FIG. 4. The device is applicable to a host of a system with A-B doors. The system with A-B doors further includes a first access control for controlling entry through the door A, a second access control for controlling entry through the door B, an electronic authorization conversion device, a third access control for controlling exit through the door B and a fourth access control for controlling exit through the door A.

The first receiving module 801 to the second sending module 808 in the embodiment shown in FIG. 8 are identical to the first receiving module 701 to the second sending module 708 in the embodiment of FIG. 7, which will not be described here.

The third receiving module 809 is for receiving a third verification request for the object to be verified sent by the third access control.

The third determination module 810 is for determining whether the door B can be opened according to the third verification request and the first validity time period.

The third sending module 811 is for sending an opening command for opening the door B to the third access control when it has been determined that the door B can be opened.

The second authorization conversion module 812 is for receiving, after the door B has been opened, an electronic authorization conversion request for the object to be verified sent by the electronic authorization conversion device, converting the authorization of the object to be verified to the authorization to pass through the door A, determining a second validity time period for passing through the door A, and storing the second validity time period.

The fourth receiving module 813 is for receiving a fourth verification request for the object to be verified sent by the fourth access control.

The second retrieving module 814 is for retrieving the stored second validity time period.

The fourth determination module 815 is for determining whether the door A can be opened according to the fourth verification request and the second validity time period.

The fourth sending module 816 is for sending an opening command for opening the door A to the fourth access control when it has been determined that the door A can be opened.

In the embodiment shown in FIG. 8, the second authorization conversion module 812 can include a second authorization conversion sub-module, a second validity time period determination sub-module and a second storage sub-module (not shown);

Wherein, the second authorization conversion sub-module is for receiving, after the door B has been opened, the electronic authorization conversion request for the object to be verified sent by the electronic authorization conversion device, and converting the authorization of the object to be verified to the authorization to pass through the door A;

the second validity time period determination sub-module is for determining the second validity time period for passing through the door A;

the second storage sub-module is for storing the second validity time period.

In the embodiment shown in FIG. 8, the second validity time period determination sub-module can be specifically for:

generating the second validity time period for the object to be verified to pass through the door A by using time of sending the opening command for opening the door B to the third access control as starting time and based on a predetermined duration of time period.

In the embodiment shown in FIG. 8, the second storage sub-module can be specifically for:

storing the second validity time period in the host; or sending the second validity time period to the electronic authorization conversion device for the electronic authorization conversion device to write the second validity time period into the object to be verified;

The second retrieving module 814 can be specifically for:

reading the second validity time period stored in the host; or retrieving the second validity time period contained in the fourth verification request, the second validity time period having been read from the object to be verified by the fourth access control and added into the fourth verification request.

In the embodiment shown in FIG. 8, the fourth verification request contains a timestamp indicating the time at which the object to be verified is read.

The fourth determination module 815 is specifically for:

determining whether the door B is closed, and if it is not closed, determining that the door A cannot be opened;

and if it is closed, determining whether the object to be verified has the authorization to pass through the door A according to the fourth verification request, and if it does not, determining that the door A cannot be opened, and if it does, determining whether the timestamp is within the second validity time period according to the timestamp contained in the fourth verification request, and if it is, determining that the door A can be opened, otherwise, determining that the door A cannot be opened.

Figure 9:
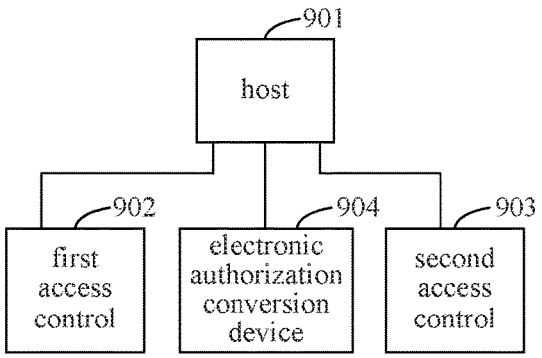
FIG. 9 is a schematic structural view of a system with A-B doors provided by embodiments of the present application.

FIG. 9 is a schematic structural view of a system with A-B doors provided by embodiments of the present application, which corresponds to the method embodiment shown in FIG. 2. The system with A-B doors includes a host 901, a first access control 902 for controlling entry through the door A, a second access control 903 for controlling entry through the door B and an electronic authorization conversion device 904;

wherein, the host 901 is for receiving a first verification request for an object to be verified sent by the first access control 902; determining whether the object to be verified has authorization to pass through the door A according to the first verification request, and if so, sending an opening command for opening the door A to the first access control 902; receiving, after the door A has been opened, an electronic authorization conversion request for the object to be verified sent by the electronic authorization conversion device 904, converting the authorization of the object to be verified to the authorization to pass through the door B, determining a first validity time period for passing through the door B, and storing the first validity time period; receiving a second verification request for the object to be verified sent by the second access control 903; retrieving the stored first validity time period; determining whether the door B can be opened according to the second verification request and the first validity time period, and if so, sending an opening command for opening the door B to the second access control 903;

the first access control 902 is for sending the first verification request for the object to be verified to the host 901, and receiving the opening command for opening the door A sent by the host 901;

the second access control 903 is for sending the second verification request for the object to be verified to the host 901, and receiving the opening command for opening the door B sent by the host 901;

the electronic authorization conversion device 904 is for sending, after the door A has been opened, the electronic authorization conversion request for the object to be verified to the host 901.

Figure 10:
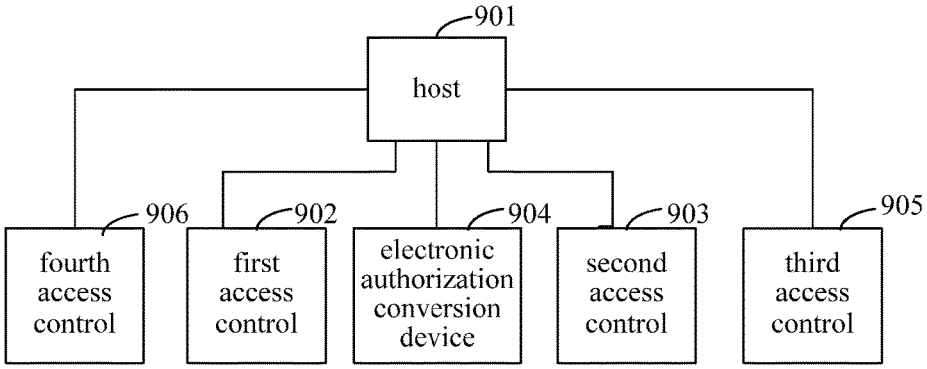
FIG. 10 is another schematic structural view of the system with A-B doors provided by embodiments of the present application.

In another embodiment of the present application, the embodiment shown in FIG. 9 can further include a third access control 905 for controlling exit through the door B and a fourth access control 906 for controlling exit through the door A, as shown in FIG. 10. This embodiment corresponds to the method embodiment shown in FIG. 5;

wherein, the host 901 is for receiving a third verification request for the object to be verified sent by the third access control 905; determining whether the door B can be opened according to the third verification request and the first validity time period, and if so, sending an opening command for opening the door B to the third access control 905; receiving, after the door B has been opened, an electronic authorization conversion request for the object to be verified sent by the electronic authorization conversion device 904, converting the authorization of the object to be verified to the authorization to pass through the door A, determining a second validity time period for passing through the door A, and storing the second validity time period; receiving a fourth verification request for the object to be verified sent by the fourth access control 906; retrieving the stored second validity time period; determining whether the door A can be opened according to the fourth verification request and the second validity time period, and if so, sending an opening command for opening the door A to the fourth access control 906;

the third access control 905 is for sending the third verification request for the object to be verified to the host 901; receiving the opening command for opening the door B sent by the host 901;

the fourth access control 906 is for sending the fourth verification request for the object to be verified to the host 901; receiving the opening command for opening the door A sent by the host 901;

the electronic authorization conversion device 904 is for sending, after the door B has been opened, the electronic authorization conversion request for the object to be verified to the host.

The technical effects of the device and system embodiments are the same as those of the method as they are obtained based on the method embodiments, and therefore are not described here.

The device and system embodiments are briefly described since they are substantially similar to the method embodiments, and one need only refer to the description of the method embodiments for related contents.

Figure 11:
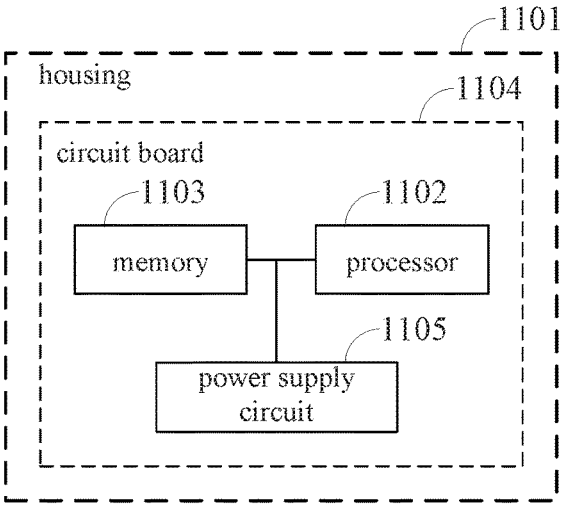
FIG. 11 is a schematic structural view of a host of a system with A-B doors provided by embodiments of the present application.

Embodiments of the present application provide a host of a system with A-B doors, the system with A-B doors further including a first access control for controlling entry through the door A, a second access control for controlling entry through the door B and an electronic authorization conversion device. As shown in FIG. 11, the host computer includes:

A housing 1101, a processor 1102, a memory 1103, a circuit board 1104 and a power supply circuit 1105, wherein, the circuit board 1104 is disposed inside the space enclosed by the housing, the processor 1102 and the memory 1103 are arranged on the circuit board 1104;

the power supply circuit 1105 is for supplying electrical power to each circuit or device of the host;

the memory 1103 is for storing executable program codes;

the processor 1102 executes programs corresponding to the executable program codes by reading the executable program codes stored in the memory 1103 to execute the following steps:

receiving a first verification request for the object to be verified sent by the first access control;

determining whether the object to be verified has the authorization to pass through the door A according to the first verification request, and if so, sending an opening command for opening the door A to the first access control;

receiving, after the door A has been opened, an electronic authorization conversion request for the object to be verified sent by the electronic authorization conversion device, converting the authorization of the object to be verified to the authorization to pass through the door B, determining the first validity time period for passing through the door B, and storing the first validity time period;

receiving a second verification request for the object to be verified sent by the second access control;

retrieving the stored first validity time period;

determining whether the door B can be opened according to the second verification request and the first validity time period, and if so, sending an opening command for opening the door B to the second access control.

In this embodiment, the host can be in various forms, including but not limited to:

(1) A mobile communication device: this type of device is characterized by the capability of mobile communication, which provides voice, data communication as its main purposes. Terminals of this type include: smart phones (such as iPhone), multimedia cellphones, functional cellphones, and low-end cellphones.

(2) An ultra-mobile personal computer device: this type of device belongs to the category of personal computers, has computing and processing functions and generally also has mobile networking property. Terminals of this type include: PDA, MID and UMPC devices, such as iPad.

(3) A portable entertainment device: this type of devices can display and play multimedia contents. Devices of this type include: audio and video players (e.g. iPods), handheld game consoles, e-book readers, as well as intelligent toys and portable on-board navigation devices.

(4) A server: as a device providing computing services, a server consists of a processor, a hard disk, a RAM, a system bus. The architecture of a server is similar with that of a general computer, but, due to the need to provide highly reliable services, has relatively high requirements in terms of processing capacity, stability, reliability, safety, expandability, and manageability.

(5) Other electronic devices with a data interaction function.

It can be seen that in the present embodiment, when the door A has been opened and the electronic authorization conversion request sent by the electronic authorization device for the object to be verified has been received, not only is the authorization of the object to be verified to be converted to the authorization to pass through the door B, but also the first validity time period for passing through the door B is to be determined. Then, whether the door B can be opened is determined according to the first validity time period when the second verification request for the object to be verified has been received. In the prior art, only the authorization of the object to be verified is converted to the authorization to pass through the door B when electronic authorization conversion is performed, and thereafter, if the object to be verified no longer undergoes any electronic authorization conversion, its authorization will remain as the authorization to pass through the door B. Therefore, the security of the A-B doors is not high enough. Embodiments of the present application set the authorization to pass through the door B to be valid within the first validity time period, and the door B cannot be opened beyond the first validity time period even if a person has the authorization to pass through the door B. Therefore, the security of the A-B doors can be improved.

Corresponding to the method embodiments, embodiments of the present application further provides an application program for executing a method for controlling the opening of A-B doors provided by embodiments of the present application when being executed, wherein, the method for controlling the opening of A-B doors includes:

receiving a first verification request for an object to be verified sent by the first access control;

determining whether the object to be verified has the authorization to pass through the door A according to the first verification request, and if so, sending an opening command for opening the door A to the first access control;

receiving, after the door A has been opened, an electronic authorization conversion request for the object to be verified sent by the electronic authorization conversion device, converting the authorization of the object to be verified to the authorization to pass through the door B, determining a first validity time period for passing through the door B, and storing the first validity time period;

receiving a second verification request for the object to be verified sent by the second access control;

retrieving the stored first validity time period;

determining whether the door B can be opened according to the second verification request and the first validity time period, and if so, sending an opening command for opening the door B to the second access control.

It can be seen that in the present embodiment, when the door A has been opened and the electronic authorization conversion request for the object to be verified sent by the electronic authorization conversion device has been received, not only is the authorization of the object to be verified to be converted to the authorization to pass through the door B, but also the first validity time period for passing through the door B is to be determined. Then, whether the door B can be opened is determined according to the first validity time period when the second verification request for the object to be verified has been received. In the prior art, only the authorization of the object to be verified is converted to the authorization to pass through the door B when electronic authorization conversion is performed, and thereafter, if the object to be verified no longer undergoes any electronic authorization conversion, its authorization will remain as the authorization to pass through the door B. Therefore, the security of the A-B doors is not high enough. Embodiments of the present application set the authorization to pass through the door B to be valid within the first validity time period, and the door B cannot be opened beyond the first validity time period even if a person has the authorization to pass through the door B. Therefore, the security of the A-B doors can be improved.

Corresponding to the method embodiments, embodiments of the present application further provide a storage medium for storing executable codes for executing a method for controlling the opening of A-B doors provided by embodiments of the present application when being executed, wherein, the method for controlling the opening of A-B doors includes:

receiving a first verification request for the object to be verified sent by the first access control;

determining whether the object to be verified has the authorization to pass through the door A according to the first verification request, and if so, sending an opening command for opening the door A to the first access control;

receiving, after the door A has been opened, an electronic authorization conversion request for the object to be verified sent by the electronic authorization conversion device, converting the authorization of the object to be verified to the authorization to pass through the door B, determining a first validity time period for passing through the door B, and storing the first validity time period;

receiving a second verification request for the object to be verified sent by the second access control;

retrieving the stored first validity time period;

determining whether the door B can be opened according to the second verification request and the first validity time period, and if so, sending an opening command for opening the door B to the second access control.

It can be seen that in the present embodiment, when the door A has been opened and the electronic authorization conversion request for the object to be verified by the electronic authorization conversion device has been received, not only is the authorization of the object to be verified to be converted to the authorization to pass through the door B, but also the first validity time period for passing through the door B is to be determined. Then, whether the door B can be opened is determined according to the first validity time period when the second verification request for the object to be verified has been received. In the prior art, only the authorization of the object to be verified is converted to the authorization to pass through the door B when electronic authorization conversion is performed, and thereafter, if the object to be verified no longer undergoes any electronic authorization conversion, its authorization will remain as the authorization to pass through the door B. Therefore, the security of the A-B doors is not high enough. Embodiments of the present application set the authorization to pass through the door B to be valid within the first validity time period, and the door B cannot be opened beyond the first validity time period even if a person has the authorization to pass through the door B. Therefore, the security of the A-B doors can be improved.

It should be noted that the relationship terms herein such as "first" and "second" are only used to distinguish one object or operation from another object or operation, without necessarily requiring or implying that there is actually any such relationship or order between these objects or operations. Moreover, the terms such as "comprise", "contain" or any variants thereof are intended to cover a non-exclusive inclusion, such that processes, methods, objects or devices comprising a series of elements include not only those elements, but also other elements not specifically listed or elements inherent in these processes, methods, objects, or devices. Without further limitations, elements limited by the wording "comprise(s) a/an . . . ." do not exclude that there are additional identical elements in the processes, methods, objects, or devices that include these elements.

It can be understood by those ordinary persons skilled in the art that all or a part of the steps in the implementations described above can be carried out by hardware instructed by programs that can be stored in a computer readable storage medium. The reference to storage medium here means ROM/RAM, magnetic disks, CDs, etc.

What have been described above are merely preferred embodiments of the present application, and not intended to limit the scope of protection of the present application. Any modifications, equivalent substitutions, improvements within the spirit and principle of the present application all fall within the scope of protection of the present application.

The invention claimed is:

1. A method for controlling opening of A-B doors, wherein it is applicable to a host of a system with A-B doors, the system with A-B doors further comprising a first access control for controlling entry through the door A, a second access control for controlling entry through the door B and an electronic authorization conversion device, the method comprising:

receiving a first verification request for an object to be verified sent by the first access control;

determining whether the object to be verified has authorization to pass through the door A according to the first verification request, and if so, sending an opening command for opening the door A to the first access control;

receiving, after the door A has been opened, an electronic authorization conversion request for the object to be verified sent by the electronic authorization conversion device, converting the authorization of the object to be verified to authorization to pass through the door B, determining a first validity time period for passing through the door B, and storing the first validity time period;

receiving a second verification request for the object to be verified sent by the second access control;

retrieving the stored first validity time period;

determining whether the door B can be opened according to the second verification request and the first validity time period, and if so, sending an opening command for opening the door B to the second access control.

2. The method according to claim 1, wherein, determining the first validity time period for passing through the door B comprises:

generating the first validity time period for the object to be verified to pass through the door B by using time of sending the opening command for opening the door A to the first access control as starting time and based on a predetermined duration of time period.

3. The method according to claim 1, wherein, storing the first validity time period comprises:

storing the first validity time period in the host; or sending the first validity time period to the electronic authorization conversion device for the electronic authorization conversion device to write the first validity time period into the object to be verified;

retrieving the stored first validity time period comprises:

reading the first validity time period stored in the host; or retrieving the first validity time period contained in the second verification request, the first validity time period having been read from the object to be verified by the second access control and added into the second verification request.

4. The method according to claim 1, wherein, the second verification request contains a timestamp indicating time at which the object to be verified is read;

determining whether the door B can be opened according to the second verification request and the first validity time period comprises:

determining whether the door A is closed, and if it is not closed, determining that the door B cannot be opened;

and if it is closed, determining whether the object to be verified has the authorization to pass through the door B according to the second verification request, and if it does not, determining that the door B cannot be opened;

and if it does, determining whether the timestamp is within the first validity time period according to the timestamp contained in the second verification request, and if it is, determining that the door B can be opened, otherwise, determining that the door B cannot be opened.

5. The method according to claim 1, wherein, the system with A-B doors further comprises a third access control for controlling exit through the door B and a fourth access control for controlling exit through the door A; the method further comprises:

receiving a third verification request for the object to be verified sent by the third access control;

determining whether the door B can be opened according to the third verification request and the first validity time period, and if so, sending an opening command for opening the door B to the third access control;

receiving, after the door B has been opened, an electronic authorization conversion request for the object to be verified sent by the electronic authorization conversion device, converting the authorization of the object to be verified to the authorization to pass through the door A, determining a second validity time period for passing through the door A, and storing the second validity time period;

receiving a fourth verification request for the object to be verified sent by the fourth access control;

retrieving the stored second validity time period;

determining whether the door A can be opened according to the fourth verification request and the second validity time period, and if so, sending an opening command for opening the door A to the fourth access control.

6. The method according to claim 5, wherein, determining the second validity time period for passing through the door A comprises:

generating the second validity time period for the object to be verified to pass through the door A by using time of sending the opening command for opening the door B to the third access control as starting time and based on a predetermined duration of time period.

7. The method according to claim 5, wherein, storing the second validity time period comprises:

storing the second validity time period in the host; or sending the second validity time period to the electronic authorization conversion device for the electronic authorization conversion device to write the second validity time period into the object to be verified;

retrieving the stored second validity time period comprises:

reading the second validity time period stored in the host; or retrieving the second validity time period contained in the fourth verification request, the second validity time period having been read from the object to be verified by the fourth access control and added into the fourth verification request.

8. The method according to claim 5, wherein, the fourth verification request contains a timestamp indicating the time at which the object to be verified is read;

determining whether the door A can be opened according to the fourth verification request and the second validity time period comprises:

determining whether the door B is closed, and if it is not closed, determining that the door A cannot be opened;

and if it is closed, determining whether the object to be verified has the authorization to pass through the door A according to the fourth verification request, and if it does not, determining that the door A cannot be opened;

and if it does, determining whether the timestamp is within the second validity time period according to the timestamp contained in the fourth verification request, and if it is, determining that the door A can be opened, otherwise, determining that the door A cannot be opened.

9. A device for controlling opening of A-B doors, wherein, it is applicable to a host of a system with A-B doors, the system with A-B doors further comprising a first access control for controlling entry through the door A, a second access control for controlling entry through the door B and an electronic authorization conversion device, the device comprising:

a first receiving module, for receiving a first verification request for an object to be verified sent by the first access control;

a first determination module, for determining whether the object to be verified has authorization to pass through the door A according to the first verification request;

a first sending module, for sending an opening command for opening the door A to the first access control when it has been determined that the object to be verified has the authorization to pass through the door A;

a first authorization conversion module, for receiving, after the door A has been opened, an electronic authorization conversion request for the object to be verified sent by the electronic authorization conversion device, converting the authorization of the object to be verified to authorization to pass through the door B, determining a first validity time period for passing through the door B, and storing the first validity time period;

a second receiving module, for receiving a second verification request for the object to be verified sent by the second access control;

a first retrieving module, for retrieving the stored first validity time period;

a second determination module, for determining whether the door B can be opened according to the second verification request and the first validity time period; and a second sending module, for sending an opening command for opening the door B to the second access control when it has been determined that the door B can be opened.

10. The device according to claim 9, wherein, the first authorization conversion module comprises a first authorization conversion sub-module, a first validity time period determination sub-module and a first storage sub-module;

the first authorization conversion sub-module is for receiving, after the door A has been opened, the electronic authorization conversion request for the object to be verified sent by the electronic authorization conversion device, and converting the authorization of the object to be verified to the authorization to pass through the door B;

the first validity time period determination sub-module is for determining the first validity time period for passing through the door B;

the first storage sub-module is for storing the first validity time period.

11. The device according to claim 10, wherein, the first validity time period determination sub-module is specifically for generating the first validity time period for the object to be verified to pass through the door B by using time of sending the opening command for opening the door A to the first access control as starting time and based on a predetermined duration of time period.

12. The device according to claim 10, wherein, the first storage sub-module is specifically for:

storing the first validity time period in the host; or sending the first validity time period to the electronic authorization conversion device for the electronic authorization conversion device to write the first validity time period into the object to be verified;

the first retrieving module is specifically for:

reading the first validity time period stored in the host; or retrieving the first validity time period contained in the second verification request, the first validity time period having been read from the object to be verified by the second access control and added into the second verification request.

13. The device according to claim 9, wherein, the second verification request contains a timestamp indicating the time at which the object to be verified is read;

the second determination module is specifically for:

determining whether the door A is closed, and if it is not closed, determining that the door B cannot be opened;

and if it is closed, determining whether the object to be verified has the authorization to pass through the door B according to the second verification request, and if it does not, determining that the door B cannot be opened;

and if it does, determining whether the timestamp is within the first validity time period according to the timestamp contained in the second verification request, and if it is, determining that the door B can be opened, otherwise, determining that the door B cannot be opened.

14. The device according to claim 9, wherein, the system with A-B doors further comprises a third access control for controlling exit through the door B and a fourth access control for controlling exit through the door A; the device further comprises:

a third receiving module, for receiving a third verification request for the object to be verified sent by the third access control;

a third determination module, for determining whether the door B can be opened according to the third verification request and the first validity time period;

a third sending module, for sending an opening command for opening the door B to the third access control when it has been determined that the door B can be opened;

a second authorization conversion module, for receiving, after the door B has been opened, an electronic authorization conversion request for the object to be verified sent by the electronic authorization conversion device, converting the authorization of the object to be verified to the authorization to pass through the door A, determining a second validity time period for passing through the door A, and storing the second validity time period;

a fourth receiving module, for receiving a fourth verification request for the object to be verified sent by the fourth access control;

a second retrieving module, for retrieving the stored second validity time period;

a fourth determination module, for determining whether the door A can be opened according to the fourth verification request and the second validity time period; and a fourth sending module, for sending an opening command for opening the door A to the fourth access control when it has been determined that the door A can be opened.

15. The device according to claim 14, wherein, the second authorization conversion module comprises a second authorization conversion sub-module, a second validity time period determination sub-module and a second storage sub-module;

the second authorization conversion sub-module is for receiving, after the door B has been opened, the electronic authorization conversion request for the object to be verified sent by the electronic authorization conversion device, and converting the authorization of the object to be verified to the authorization to pass through the door A;

the second validity time period determination sub-module is for determining the second validity time period for passing through the door A;

the second storage sub-module is for storing the second validity time period.

16. The device according to claim 15, wherein, the second validity time period determination sub-module is specifically for:

generating the second validity time period for the object to be verified to pass through the door A by using time of sending the opening command for opening the door B to the third access control as starting time and based on a predetermined duration of time period.

17. The device according to claim 15, wherein, the second storage sub-module is specifically for:

storing the second validity time period in the host; or sending the second validity time period to the electronic authorization conversion device for the electronic authorization conversion device to write the second validity time period into the object to be verified;

the second retrieving module is specifically for:

reading the second validity time period stored in the host; or retrieving the second validity time period contained in the fourth verification request, the second validity time period having been read from the object to be verified by the fourth access control and added into the fourth verification request.

18. The device according to claim 14, wherein the fourth verification request contains a timestamp indicating the time at which the object to be verified is read;

the fourth determination module is specifically for:

determining whether the door B is closed, and if it is not closed, determining that the door A cannot be opened;

and if it is closed, determining whether the object to be verified has the authorization to pass through the door A according to the fourth verification request, and if it does not, determining that the door A cannot be opened; and if it does, determining whether the timestamp is within the second validity time period according to the timestamp contained in the fourth verification request, and if it is, determining that the door A can be opened, otherwise, determining that the door A cannot be opened.

19. A system with A-B doors, wherein, it comprises a host, a first access control for controlling entry through the door A, a second access control for controlling entry through the door B and an electronic authorization conversion device;

wherein, the host is for receiving a first verification request for an object to be verified sent by the first access control; determining whether the object to be verified has authorization to pass through the door A according to the first verification request, and if so, sending an opening command for opening the door A to the first access control;

receiving, after the door A has been opened, an electronic authorization conversion request for the object to be verified sent by the electronic authorization conversion device, converting the authorization of the object to be verified to authorization to pass through the door B, determining a first validity time period for passing through the door B, and storing the first validity time period; receiving a second verification request for the object to be verified sent by the second access control; retrieving the stored first validity time period; determining whether the door B can be opened according to the second verification request and the first validity time period, if so, sending an opening command for opening the door B to the second access control;

the first access control is for sending the first verification request for the object to be verified to the host; receiving the opening command for opening the door A sent by the host;

the second access control is for sending the second verification request for the object to be verified to the host; receiving the opening command for opening the door B sent by the host;

the electronic authorization conversion device is for sending, after the door A has been opened, the electronic authorization conversion request for the object to be verified to the host.

20. The system according to claim 19, wherein, it further comprises a third access control for controlling exit through the door B and a fourth access control for controlling exit through the door A;

wherein, the host is for receiving a third verification request for the object to be verified sent by the third access control; determining whether the door B can be opened according to the third verification request and the first validity time period, and if so, sending an opening command for opening the door B to the third access control; receiving, after the door B has been opened, an electronic authorization conversion request for the object to be verified sent by the electronic authorization conversion device, converting the authorization of the object to be verified to the authorization to pass through the door A, determining a second validity time period for passing through the door A, and storing the second validity time period; receiving a fourth verification request for the object to be verified sent by the fourth access control; retrieving the stored second validity time period; determining whether the door A can be opened according to the fourth verification request and the second validity time period, and if so, sending an opening command for opening the door A to the fourth access control;

the third access control is for sending the third verification request for the object to be verified to the host; receiving the opening command for opening the door B sent by the host;

the fourth access control is for sending the fourth verification request for the object to be verified to the host; receiving the opening command for opening the door A sent by the host;

the electronic authorization conversion device is for sending, after the door B has been opened, the electronic authorization conversion request for the object to be verified to the host.

21. A host of a system with A-B doors, wherein, the system with A-B doors further comprises a first access control for controlling entry through the door A, a second access control for controlling entry through the door B and an electronic authorization conversion device; the host comprises:

a housing, a processor, a memory, a circuit board and a power supply circuit, wherein, the circuit board is disposed inside the space enclosed by the housing, the processor and the memory are arranged on the circuit board; the power supply circuit is for supplying electrical power to each circuit or device of the host; the memory is used to store executable program codes; the processor executes programs corresponding to the executable program codes by reading the executable program codes stored in the memory to perform the following steps:

receiving a first verification request for an object to be verified sent by the first access control;

determining whether the object to be verified has authorization to pass through the door A according to the first verification request, and if so, sending an opening command for opening the door A to the first access control;

receiving, after the door A has been opened, an electronic authorization conversion request for the object to be verified sent by the electronic authorization conversion device, converting the authorization of the object to be verified to authorization to pass through the door B, determining a first validity time period for passing through the door B, and storing the first validity time period;

receiving a second verification request for the object to be verified sent by the second access control;

retrieving the stored first validity time period;

determining whether the door B can be opened according to the second verification request and the first validity time period, and if so, sending an opening command for opening the door B to the second access control.

22. A non-transitory computer storage medium, wherein, it is for storing executable codes for executing the method for controlling opening of A-B doors as claimed in claim 1 when executed.

* * * * *